US006955498B1

(12) United States Patent
McCuan et al.

(10) Patent No.: US 6,955,498 B1
(45) Date of Patent: Oct. 18, 2005

(54) CIRCULAR CONDUIT OPENING CLOSURE DEVICE

(76) Inventors: Scott McCuan, 4330 University Ave., Bakersfield, CA (US) 93306; Kent Sloan, 2809 Dartmouth St., Bakersfield, CA (US) 93305

( * ) Notice: Subject to any disclaimer, the term of this patent is extended or adjusted under 35 U.S.C. 154(b) by 0 days.

(21) Appl. No.: 10/645,167

(22) Filed: Aug. 20, 2003

(51) Int. Cl.[7] ..... E02D 29/14; E01C 11/22
(52) U.S. Cl. ..... 404/25; 404/4; 52/19
(58) Field of Search ..... 52/19, 20; 404/25, 404/26, 2–5; 405/52, 80

(56) References Cited

U.S. PATENT DOCUMENTS

| | | | | | |
|---|---|---|---|---|---|
| 988,109 | A | * | 3/1911 | Kaufmann | 285/322 |
| 1,310,055 | A | | 7/1919 | Caldwell | |
| 1,709,165 | A | * | 4/1929 | Bower | 84/415 |
| 1,908,909 | A | * | 5/1933 | Manz | 52/19 |
| 2,145,613 | A | * | 1/1939 | Shenk et al. | 220/495.11 |
| 2,640,717 | A | * | 6/1953 | Scheuring | 285/411 |
| 3,661,409 | A | * | 5/1972 | Brown et al. | 285/82 |
| 3,891,337 | A | * | 6/1975 | McCoy | 404/26 |
| 3,920,347 | A | * | 11/1975 | Sauriol et al. | 404/25 |
| 4,097,171 | A | * | 6/1978 | Fier | 404/26 |
| 4,225,266 | A | * | 9/1980 | Fier | 404/26 |
| 4,302,126 | A | * | 11/1981 | Fier | 404/26 |
| 4,419,232 | A | | 12/1983 | Arntyr | |
| 4,438,958 | A | * | 3/1984 | De Cenzo | 285/234 |
| 4,549,462 | A | * | 10/1985 | Hartry et al. | 84/413 |
| 4,592,576 | A | * | 6/1986 | Proctor et al. | 285/253 |
| 4,637,585 | A | * | 1/1987 | Picollo | 249/10 |
| 4,659,251 | A | * | 4/1987 | Petter et al. | 405/52 |
| 4,660,870 | A | * | 4/1987 | Donley | 285/419 |
| 4,867,601 | A | * | 9/1989 | Bowman | 404/26 |
| 4,872,780 | A | * | 10/1989 | Bowman | 404/26 |
| 4,927,290 | A | * | 5/1990 | Bowman | 404/26 |
| 4,963,053 | A | * | 10/1990 | Bowman | 404/26 |
| 5,143,478 | A | * | 9/1992 | Bowman | 404/26 |
| 5,150,984 | A | * | 9/1992 | Bowman et al. | 404/26 |
| 5,165,819 | A | * | 11/1992 | Bowman | 404/26 |
| 5,184,912 | A | * | 2/1993 | Bowman et al. | 404/25 |
| 5,209,601 | A | * | 5/1993 | Odill et al. | 404/26 |
| 5,224,514 | A | | 7/1993 | Taylor | |
| RE34,550 | E | * | 2/1994 | Bowman | 404/26 |
| 5,297,367 | A | | 3/1994 | Sainz | |
| 5,316,407 | A | * | 5/1994 | Miller | 404/25 |
| 5,382,113 | A | * | 1/1995 | Chilton et al. | 404/25 |
| 5,477,767 | A | * | 12/1995 | May | 84/421 |
| 5,527,131 | A | * | 6/1996 | Salmond et al. | 405/52 |
| 5,536,457 | A | * | 7/1996 | Topf, Jr. | 264/32 |
| 5,829,624 | A | * | 11/1998 | Skolnik et al. | 220/320 |
| 6,017,166 | A | | 1/2000 | Mossburg, Jr. | |
| 6,036,401 | A | | 3/2000 | Morina | |
| 6,367,843 | B1 | * | 4/2002 | Fetzer | 285/24 |
| 6,537,446 | B1 | | 3/2003 | Sanguinetti | |
| 6,537,447 | B2 | | 3/2003 | Remon | |
| 2002/0023864 | A1 | | 2/2002 | Peterson | |
| 2002/0104789 | A1 | | 8/2002 | Harris | |
| 2003/0098267 | A1 | | 5/2003 | Page | |

* cited by examiner

*Primary Examiner*—Thomas B. Will
*Assistant Examiner*—Alexandra Pechhold
(74) *Attorney, Agent, or Firm*—Dennis W. Beech

(57) ABSTRACT

The closure device for a circular conduit opening may be used to inhibit entry of debris and other matter into a conduit. The closure device may have an outer band, an inner band and a cover wherein a perimeter edge of the cover may be fastened between the outer band and the inner band. The outer band may have two separated overlapping ends and the inner band having two separated ends. A clamp may be attached to one of the inner band and the outer band.

15 Claims, 2 Drawing Sheets

CIRCULAR CONDUIT OPENING CLOSURE DEVICE

BACKGROUND OF THE INVENTION

This invention relates to devices that may be used for closure of circular conduits such as pipes, shafts and access openings for storm drains, sewer access manholes, utility equipment vaults and the like that may be located in the ground. The new closure device may be positioned and secured in a conduit to inhibit entry of debris that may be produced as a result of construction work or other activity when other closure devices have been removed or may be.

Devices for closure of circular conduits have been in use for many years. A well known device, the manhole cover, that may be made of metal is typically used to cover a conduit opening at street level to close opening access to sewers, underground equipment vaults, storm drains and other underground facilities such as valve control access enclosures and the like. Other closure devices may have been designed to temporarily or permanently close or partially close conduit openings such as storm drains to filter debris from entering fluids to avoid clogging the drain system. The conduit with opening may be generally vertical or may be other than vertical yet a closure device may be necessary to inhibit entry of debris or other matter when the conduit opening is not being used for access entry or other intended purposes. For example, when a street may be repaired, often the manhole covers may be removed and the access opening covered with street level metal plates. However, these temporary coverings may be unintentionally moved allowing debris to fall into the conduit and for example into the sewer.

SUMMARY OF THE INVENTION

The present invention is directed to devices that may be used to inhibit entry of debris and other matter into a conduit. The closure device may have an outer band, an inner band and a cover wherein a perimeter edge of the cover may be fastened between the outer band and the inner band. The outer band may have two separated overlapping ends and the inner band may have two separated ends. A clamp may be attached to one of the inner band and the outer band.

These and other features, aspects and advantages of the present invention will become better understood with reference to the following drawings, description and claims.

DETAILED DESCRIPTION

The following detailed description represents the best currently contemplated modes for carrying out the invention. The description is not to be taken in a limiting sense, but is made merely for the purpose of illustrating the general principles of the invention.

Figure 1:
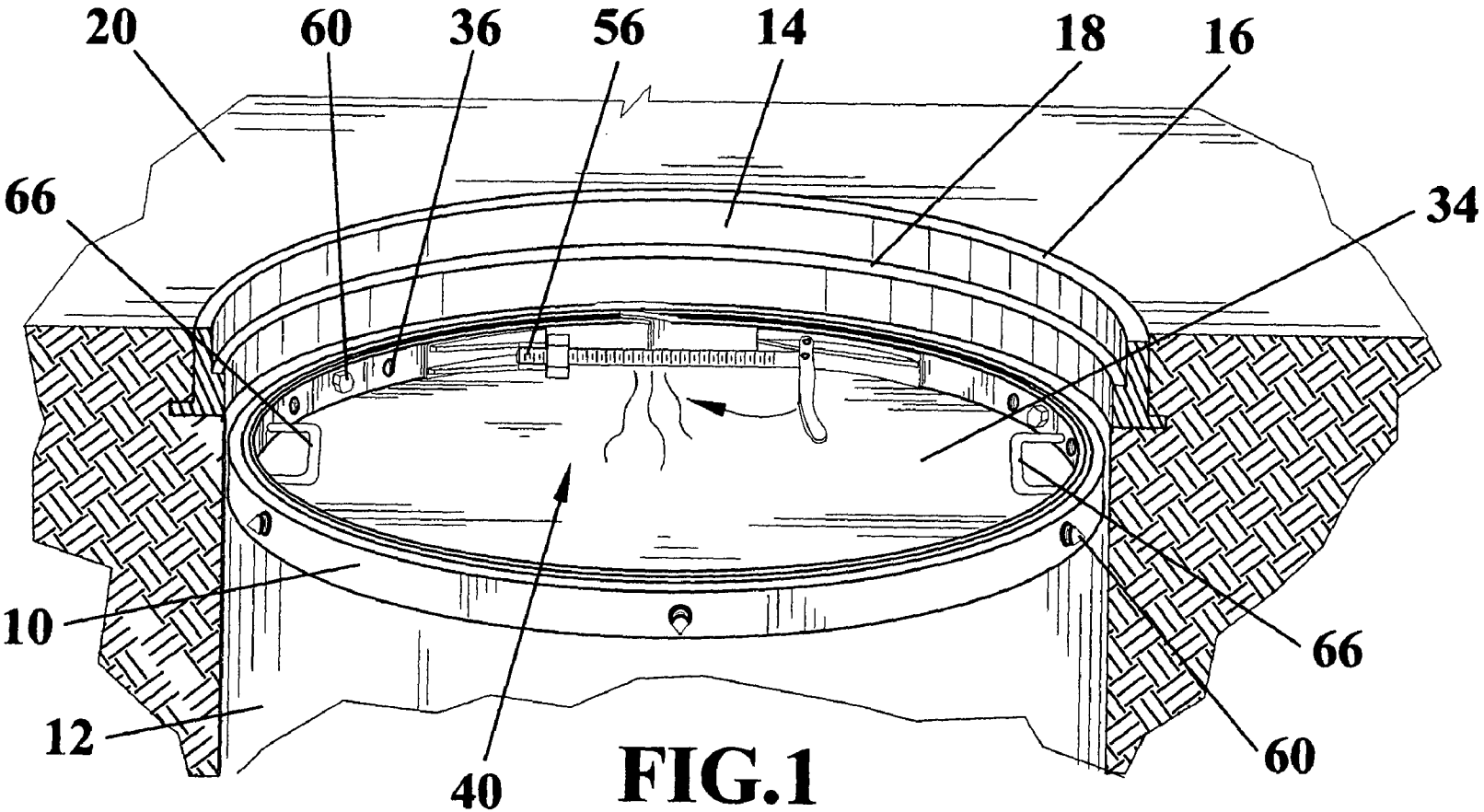
FIG. 1 illustrates a perspective view of a circular conduit opening closure device installed adjacent the access opening for a street level manhole according to an embodiment of the invention.

Referring to FIG. 1, a closure device 10 may be installed in a conduit 12 adjacent to an access opening 14 having an opening ring 16 with shoulder 18. The access opening 14 may normally be closed by a metal manhole cover (not shown) or other device that rests on shoulder 18. If the upper surface 20 may be a street that is undergoing repair, when the manhole cover may be removed during repair debris may enter the conduit 12. The closure device 10 may be installed below the edge of the access opening 14 to not interfere with the repair work, yet be located to catch debris that may fall into the access opening 14.

Figure 3:
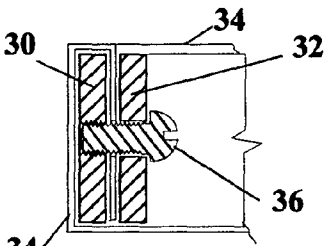
FIG. 3 illustrates a partial elevation cross sectional view of the closure device according to an embodiment of the invention.
Figure 2:
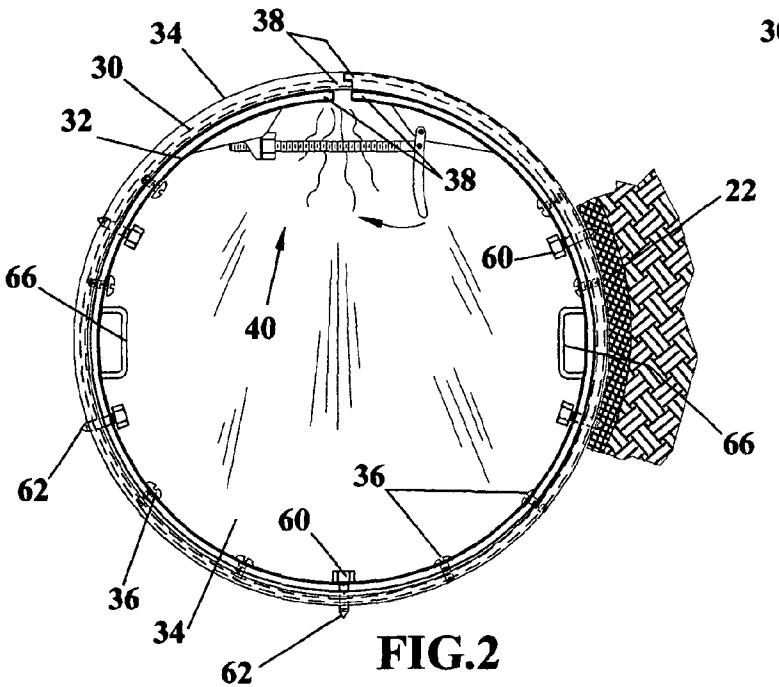
FIG. 2 illustrates a top plan view of the closure device installed in the access opening according to an embodiment of the invention.

Referring to FIGS. 1 through 3, the closure device 10 may have an outer band 30 or ring, an inner band 32 or ring and a cover 34. The cover 34 may be formed of a flexible material similar to a waterproof or treated canvas that may be multilayered and use neoprene or other composition material appropriate for the intended application to prevent debris passing therethrough. The bands 30, 32 may be formed of stainless steel or other composition material with protective coating if necessary for environmental protection. The bands 30, 32 may be elastic to allow installation and removal by use of a clamp 40. The bands 30, 32 and cover 34 may be assembled by folding the cover 34 perimeter edge around the outer band 30 and fastening the inner band 32 to the outer band 30 with screws 36 or other fasteners such as rivets and the like as best viewed in FIG. 3.

The bands 30, 32 may have separated overlapping ends 38 to allow expansion and retraction of the bands 30, 32 for installation and removal of the closure device 10. When the clamp 40 may be disengaged the bands 30, 32 may have a smaller diameter than when clamp 40 is engaged to force the bands to expand against for example a conduit wall 22. In the expanded condition, the closure device 10 may be secured against the conduit wall 22 to prevent movement of the closure device 10 by frictional force between the conduit wall 22 and the closure device 10 forced expansion against the conduit wall 22 by the bands 30, 32 and clamp 40. When it may be desired to remove the closure device 10, the clamp 40 may be disengaged by lever 42 to remove the expansion force.

Figure 4:
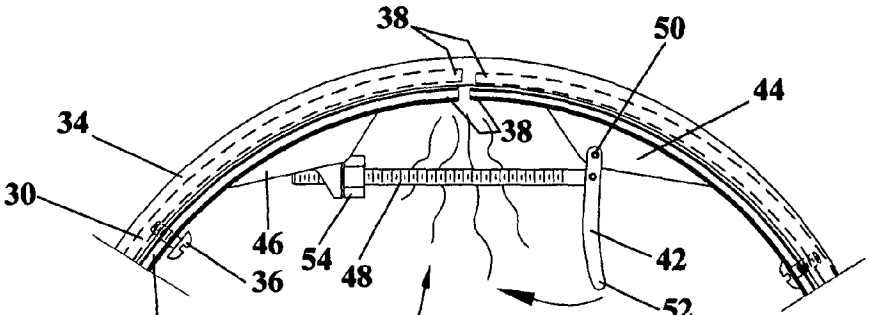
FIG. 4 illustrates a partial view of the closure device and a clamp according to an embodiment of the invention.
Figure 5:
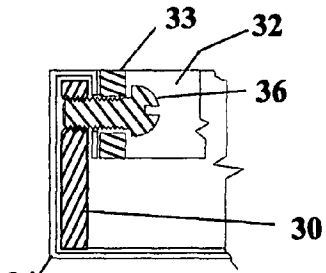
FIG. 5 illustrates a partial elevation cross sectional view of the closure device according to an embodiment of the invention.

Referring to FIGS. 2, 4 and 5 the clamp 40 may have a lever bracket 44 and a rod retainer bracket 46 that may be attached to the inner band 32, to the outer band 30 if inner band 32 ends 38 are shortened or otherwise modified to allow such attachment, or to the inner band 32 and outer band 30. As an example, the inner band 32 may be narrow as compared to the outer band 30, as best viewed in FIG. 5, to allow attachment of the clamp 40 to the outer band 30. In this configuration the inner band 32 may have non-overlapping ends 38 that may be sufficiently separated to not interfere with contraction of the bands 32, 34 when the clamp 40 may be disengaged. The inner band 32 may have the upper edge 33 at approximately the same height as the cover 34 portion folded over the outer band 30 for protection of the cover 34.

The lever brackets 44 may have a lever 42 rotatably attached. There may be an adjustment rod 48 rotatably attached to the lever 42 intermediate the rotation end 50 and the distal end 52. The adjustment rod 48 may be threaded for receipt of a nut 54. The rod retainer bracket 46 may have an aperture, a groove, an opening 56 or the like for receipt of the adjustment rod 48, but may not allow the nut 54 to pass therethrough. When the nut 54 may be adjusted to a position on adjustment rod 48 for a desired expansion of bands 30, 32, the adjustment rod 48 may be placed in opening 56 and the lever 42 rotated to expand the rings 30, 32 as nut 54 may be forced against rod retainer bracket 46.

There may be anchor bolts 60 threadably engaged with outer band 30, inner band 32 or both. The anchor bolts 60 may have tapered end 62 for engagement with a conduit wall 22 when the anchor bolt 60 is rotated to move outwardly from the bands 30, 32. This may provide an additional securing structure for the closure device 10.

There may be one or more handles 66 attached to inner ring 32 for use during installation and removal of the closure device 10.

While the invention has been particularly shown and described with respect to the illustrated embodiments thereof, it will be understood by those skilled in the art that the foregoing and other changes in form and details may be made therein without departing from the spirit and scope of the invention.

We claim:

1. A device to inhibit entry of debris and other matter into a conduit comprising:

an outer band, an inner band wherein said inner band disposed interior to said outer band and a cover wherein a perimeter edge of said cover is wrapped around said outer band and is fastened between said outer band and said inner band;

said outer band having two separated ends and said inner band having two separated ends; and an expansion clamp attached to one of said inner band and said outer band.

2. The device as in claim 1 wherein said outer band having a portion of said outer band overlapping adjacent said two separated ends and said expansion clamp is attached to said inner band.

3. The device as in claim 1 wherein said fastening is with a plurality of screws.

4. The device as in claim 1 wherein said expansion clamp comprising:

a lever bracket having a lever rotatably attached at a lever rotation end;

an adjustment rod rotatably attached to said lever intermediate said lever rotation end and a distal end; and a rod retainer bracket having an opening therein.

5. The device as in claim 4 wherein said adjustment rod is threaded for threadable engagement of a nut.

6. The device as in claim 1 wherein a plurality of anchor bolts are threadably engaged with one of said inner band and said outer band; and said anchor bolts movable through said inner band and said outer band for engagement with a conduit wall.

7. The device as in claim 1 wherein a handle is attached.

8. The device as in claim 1 wherein said inner band at an upper edge is approximately the same height as said perimeter edge wrapped around said outer band.

9. The device as in claim 1 wherein said inner band is relatively narrower than said outer band.

10. The device as in claim 9 wherein said expansion clamp is attached to said outer band.

11. A device to inhibit entry of debris and other matter into a conduit comprising:

an elastic outer band, an elastic inner band wherein said inner band disposed interior to said outer band and a flexible cover wherein a perimeter edge of said cover is fastened between said elastic outer band and said elastic inner band;

said elastic outer band having two separated ends with a portion of said outer band overlapping adjacent said two separated ends and said elastic inner band having two separated ends;

an expansion clamp attached to one of said elastic inner band and said elastic outer band wherein said elastic inner band and said elastic outer band expandable by force of said expansion clamp; and a plurality of anchor bolts are threadably engaged with one of said elastic inner band and said elastic outer band, and said anchor bolts movable through said elastic inner band and said outer band for engagement with a conduit wall.

12. The device as in claim 11 wherein said perimeter edge is wrapped around said elastic outer band prior to fastening.

13. The device as in claim 11 wherein said expansion clamp comprising:

a lever bracket having a lever rotatably attached at a lever rotation end;

an adjustment rod rotatably attached to said lever intermediate said lever rotation end and a distal end; and a rod retainer bracket having an opening therein.

14. The device as in claim 13 wherein said adjustment rod is threaded for threadable engagement of a nut.

15. The device as in claim 11 wherein a handle is attached.

* * * * *